US005821041A

United States Patent [19]

Okutsu et al.

[11] Patent Number: 5,821,041

[45] **Date of Patent: *Oct. 13, 1998**

[54] LIQUID DEVELOPER FOR PHOTOGRAPHIC SILVER HALIDE PHOTOSENSITIVE MATERIAL AND DEVELOPMENT METHOD

[75] Inventors: Eiichi Okutsu; Shigeo Hirano; Kazue Sano, all of Kanagawa, Japan

[73] Assignee: Fuji Photo Film Co., Ltd., Kangawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 777,813

[22] Filed: Dec. 31, 1996

[30] Foreign Application Priority Data

Mar. 5, 1996 [JP] Japan ..... 8-075355
May 23, 1996 [JP] Japan ..... 8-151541

[51] Int. Cl.[6] ..... G03C 7/407

[52] U.S. Cl. ..... 430/440; 430/446; 430/480; 430/483; 430/490

[58] Field of Search ..... 430/440, 446, 430/464, 480, 483, 487, 490

[56] References Cited

U.S. PATENT DOCUMENTS

| | | | |
|---|---|---|---|
| 2,311,428 | 2/1943 | Wood | 430/446 |
| 4,120,728 | 10/1978 | Ikenoue et al. | 430/618 |
| 4,141,734 | 2/1979 | Lenoir et al. | 430/445 |
| 4,310,622 | 1/1982 | Onda et al. | 430/445 |
| 4,371,610 | 2/1983 | Toyoda et al. | 430/445 |
| 4,529,689 | 7/1985 | Lee | 430/534 |
| 4,814,260 | 3/1989 | Koboshi et al. | 430/490 |
| 4,985,348 | 1/1991 | Hirano et al. | 430/434 |
| 5,229,249 | 7/1993 | Katoh et al. | 430/264 |
| 5,236,816 | 8/1993 | Purol et al. | 430/492 |
| 5,264,323 | 11/1993 | Purol et al. | 430/440 |
| 5,356,761 | 10/1994 | Morimoto et al. | 430/488 |
| 5,364,746 | 11/1994 | Inoue et al. | 430/488 |
| 5,372,911 | 12/1994 | Obi et al. | 430/490 |
| 5,384,232 | 1/1995 | Bishop et al. | 430/446 |
| 5,385,811 | 1/1995 | Hirano | 430/446 |
| 5,457,009 | 10/1995 | Toyoda et al. | 430/399 |
| 5,474,879 | 12/1995 | Fitterman et al. | 430/487 |
| 5,503,965 | 4/1996 | Okutsu | 430/399 |
| 5,506,092 | 4/1996 | Ishikawa et al. | 430/399 |
| 5,510,231 | 4/1996 | Komatsu et al. | 430/399 |
| 5,591,567 | 1/1997 | Komatsu et al. | 430/399 |

FOREIGN PATENT DOCUMENTS

| | | |
|---|---|---|
| 627658 | 12/1994 | European Pat. Off. . |
| 201968 | 7/1995 | European Pat. Off. . |
| 2019685 | 7/1995 | European Pat. Off. . |
| 752616 | 1/1997 | European Pat. Off. . |
| 54-141126 | 11/1979 | Japan . |
| 56-46585 | 11/1981 | Japan . |
| 57-26848 | 2/1982 | Japan . |
| 58-28737 | 2/1983 | Japan . |
| 62-4702 | 1/1987 | Japan . |
| 62-56959 | 3/1987 | Japan . |
| 62-183455 | 8/1987 | Japan . |
| 63-33744 | 2/1988 | Japan . |
| 63-279249 | 11/1988 | Japan . |
| 4-362942 | 12/1992 | Japan . |
| 566525 | 3/1993 | Japan . |
| 588304 | 4/1993 | Japan . |
| 2284067 | 5/1995 | United Kingdom . |
| WO97 04355 | 2/1997 | WIPO . |
| WO97 04356 | 2/1997 | WIPO . |

*Primary Examiner*—Hoa Van Le
*Attorney, Agent, or Firm*—Birch, Stewart, Kolasch & Birch, LLP

[57] ABSTRACT

The invention provides a liquid developer for photographic silver halide photosensitive material comprising a silver halide emulsion layer containing at least 50% based on the projected area of tabular silver halide grains with an aspect ratio of at least 3.0 and having a swelling factor of 130–250%. In the liquid developer containing ascorbic acid or a derivative thereof as a developing agent or preservative, a compound of formula (I):

(I)

wherein each of $R_1$ and $R_2$ is a C1–C3 hydroxyalkyl group or C1–C3 alkyl group and $R_3$ is a C1–C3 hydroxyalkyl group is added for preventing the developer from coloring with the lapse of time.

19 Claims, No Drawings

LIQUID DEVELOPER FOR PHOTOGRAPHIC SILVER HALIDE PHOTOSENSITIVE MATERIAL AND DEVELOPMENT METHOD

TECHNICAL FIELD

This invention relates to a liquid developer for photographic silver halide photosensitive material using an ascorbic acid compound as a developing agent or preservative and a method for processing photographic silver halide photosensitive material with the liquid developer.

BACKGROUND ART

Conventional developers for photographic black and white silver halide photosensitive material contain dihydroxybenzenes as a developing agent and 1-phenyl-3-pyrazolidone or derivatives thereof or p-aminophenol derivatives as an auxiliary developing agent having superadditivity. The developers for photographic silver halide photosensitive material have a high chemical oxygen demand (COD) and biological oxygen demand (BOD). As greater attention is now paid to environmental problems, it is important to reduce the amount of developer used or replenished per unit area of photographic silver halide photosensitive material for reducing the COD and BOD burdens of used developer. An improvement in the preservability of developer is crucial to this end and such an improvement will be effectively achieved as by increasing the sulfite concentration of developer. Since the sulfite is a solvent for silver halide, the sulfite, if used in large amounts, causes silver halide in the photosensitive material to be dissolved in the developer. The silver halide is eventually reduced into silver with the developing agent. Silver thus formed will deposit on the rollers and tank walls of an automatic processor and eventually deposit on films being processed, causing troubles. It is known that such troubles can be avoided by using ascorbic acid or derivatives thereof as a preservative instead of increasing the sulfite concentration. While photographic silver halide photosensitive materials have long been developed with developers containing hydroquinone as a developing agent, the toxicity of hydroquinone and pollution burdens of used developer (having high COD and BOD) are now under consideration. The industry has a greater interest in the use of ascorbic acid or derivatives thereof as a developing agent instead of hydroquinone.

However, developers containing ascorbic acid or derivatives thereof give rise to a problem of outer appearance because they are colored with the lapse of time and the color changes with time. Coloring of the developer occurs both in a sealed state contained in a container used for delivery purpose and in an open state after opening the container. In either case, the colored developer is of low commercial value since the user will doubt whether the contents are deteriorated although the colored developer causes no substantial troubles in regard to processing ability.

One countermeasure is proposed in GB 2284067A which discloses a developer solution for photographic silver halide photosensitive material comprising ascorbic acid or a derivative thereof as a developing agent wherein a hydroxylamine is added for preventing the developer from coloring. Hydroxylamines have little risk of adversely affecting the processing ability of developer, but the compounds themselves are doubted of safety.

Although the coloring of liquid developer in a sealed state is crucial when its commercial value is taken into account, no effective solution has been available.

In processing on a running basis of photographic silver halide photosensitive material with a developer solution containing ascorbic acid or a derivative thereof, sensitivity gradually lowers if the running process is continued with a smaller replenishment amount.

DISCLOSURE OF THE INVENTION

Therefore, an object of the present invention is to prevent coloring with time in a sealed state of a liquid developer for photographic silver halide photosensitive material comprising an ascorbic acid compound.

Another object of the present invention is to provide a method for developing a photographic silver halide photosensitive material with a liquid developer which enables development with a smaller replenishment amount of the liquid developer without a sensitivity drop.

According to the invention, there is provided a liquid developer for photographic silver halide photosensitive material. The developer contains an ascorbic acid compound (inclusive of ascorbic acid and derivative thereof) as a developing agent or preservative and additionally contains a compound of the following formula (I):

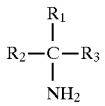

(I)

wherein each of $R_1$ and $R_2$ is a hydroxyalkyl group having 1 to 3 carbon atoms or alkyl group having 1 to 3 carbon atoms and $R_3$ is a hydroxyalkyl group having 1 to 3 carbon atoms.

The liquid developer may further contain an auxiliary developing agent having superadditivity. The liquid developer should preferably be stored in a container of a packaging material having an oxygen permeability of up to 50 $ml/m^2 \cdot 24\ hr \cdot atm$ at 20° C. and RH 65%.

In another aspect, the invention provides a method for processing a photographic silver halide photosensitive material comprising the step of developing the photosensitive material with a developer solution prepared from the developer. The photosensitive material should comprise at least one layer of a silver halide emulsion containing at least 50% of tabular silver halide grains having an aspect ratio of at least 3.0 based on the projected area of entire silver halide grains and have a swelling factor of 130 to 250%. The method may further include the step of replenishing the developer solution in an amount of up to 250 ml per square meter of the silver halide photosensitive material.

According to the present invention, a compound of formula (I) is added to a photographic silver halide photosensitive material developer comprising ascorbic acid or a derivative thereof, thereby preventing the developer from coloring with the lapse of time. The developer is thus prohibited from changing its outer appearance. It is believed that ascorbic acid or derivative thereof oxidizes and then reacts with an auxiliary developing agent in the developer with the lapse of time, to form a certain compound from which coloring matter originates although the structure of coloring matter has not been ascertained. Although the mechanism of the compound of formula (I) serving to prevent coloring is not well understood, the addition of the instant compound prevents formation of an oxide of ascorbic acid or derivative thereof and eventually restrains formation of coloring matter. The compound of formula (I) does by no means affect the processing ability of developer and free of a safety problem in contrast to hydroxylamines as disclosed in GB 2284067A.

When a photographic silver halide photosensitive material comprising at least one layer of a silver halide emulsion containing at least 50% of tabular silver halide grains having an aspect ratio of at least 3.0 based on the projected area of entire silver halide grains, having a swelling factor of 130 to 250% and featuring high sensitivity is processed on a running basis with a developer solution prepared from the inventive developer, the presence of the compound of formula (I) restrains any drop of sensitivity, maintaining high sensitivity.

The maintenance of high sensitivity is accomplished only for the photosensitive material using tabular silver halide grains. The high sensitivity feature is maintained unchanged by restricting the content of tabular silver halide grains and the swelling factor as defined above.

DESCRIPTION OF THE PREFERRED EMBODIMENT

A liquid developer for photographic silver halide photosensitive material according to the invention contains at least one ascorbic acid compound as a developing agent or preservative. The developer further contains at least one compound of the following formula (I).

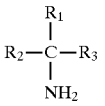

(I)

In formula (I), each of $R_1$ and $R_2$ is a hydroxyalkyl group having 1 to 3 carbon atoms or alkyl group having 1 to 3 carbon atoms. $R_3$ is a hydroxyalkyl group having 1 to 3 carbon atoms. The hydroxyalkyl group represented by $R_1$ to $R_3$ includes hydroxymethyl and hydroxyethyl. The alkyl group represented by $R_1$ and $R_2$ is preferably unsubstituted alkyl including methyl and ethyl.

Several illustrative examples of the compound of formula (I) are given below although the invention is not limited thereto.

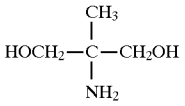

I-1

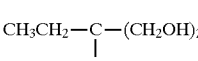

I-2

I-3

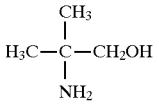

I-4

The compound of formula (I) may be used alone or in admixture of two or more. It is preferably used in an amount of 0.5 to 100 grams, more preferably 1.0 to 50 grams per liter of the developer. The compound of formula (I) used in this range is more effective for restraining the developer from coloring. Less amounts of the compound of formula (I) would be less effective for restraining coloring whereas too much amounts of the compound would be undesirable from the aspects of cost and solubility. Since the compound of formula (I) is known in the art, commercially available compounds may be used as purchased. Alternatively, the compound can be synthesized by conventional methods.

The term "ascorbic acid compound" is used herein as including ascorbic acid and derivatives thereof. The ascorbic acid compound is preferably of the following formula (II).

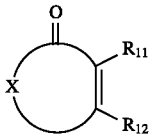

(II)

In formula (II), each of $R_{11}$ and $R_{12}$, which may be the same or different, is a hydroxyl, amino, acylamino, alkylsulfonylamino, arylsulfonylamino, alkoxycarbonylamino, mercapto or alkylthio group. X is a group of two or more atoms selected from the class consisting of carbon, oxygen and nitrogen atoms, which forms a five or six-membered ring with the two vinyl carbon atoms to which $R_{11}$ and $R_{12}$ are attached and the carbonyl carbon atom. The five or six-membered ring completed by X may have a fused ring.

Formula (II) is described in more detail.

Each of $R_{11}$ and $R_{12}$ is a hydroxyl group; amino group which may have a substituent, for example, alkyl having 1 to 10 carbon atoms such as methyl, ethyl, n-butyl and hydroxyethyl or which may form a salt; acylamino group such as acetylamino and benzoylamino; alkylsulfonylamino group such as methanesulfonylamino; arylsulfonylamino group such as benzenesulfonylamino and p-toluenesulfonylamino; alkoxycarbonylamino group such as methoxycarbonylamino and ethoxycarbonylamino; mercapto group; or alkylthio group such as methylthio and ethylthio. Preferred groups represented by $R_{11}$ and $R_{12}$ are hydroxyl, amino, alkylsulfonylamino, and arylsulfonylamino groups.

Examples of the group represented by X are combinations of —O—, —C($R_{13}$) ($R_{14}$)—, —C($R_{15}$)═, —C(═O)—, —N($R_{16}$)—, and —N═. Each of $R_{13}$, $R_{14}$, $R_{15}$, and $R_{16}$ is a hydrogen atom, substituted or unsubstituted alkyl group having 1 to 10 carbon atoms (exemplary substituents being hydroxy, carboxy, and sulfo groups), substituted or unsubstituted aryl groups having 6 to 15 carbon atoms (exemplary substituents being alkyl group, halogen atom, hydroxy, carboxy, and sulfo groups), hydroxyl group, and carboxyl group. $R_{13}$ to $R_{16}$ may constitute the ring fused to the five or six-membered ring completed by X.

Examples of the five or six-membered ring completed by X include dihydrofuranone ring, dihydropyrone,ring, pyranone ring, cyclopentenone ring, cyclohexenone ring, pyrolynone ring, pyrazolinone ring, pyridone ring, azacyclohexenone ring, and uracil ring, with the dihydrofuranone, cyclopentenone, cyclohexenone, pyrazolinone, azacyclohexenone, and uracil rings being preferred. The ring fused to this five or six-membered ring may be either saturated or unsaturated and includes a piperidine ring and benzene ring, to name a few.

Several illustrative examples of the ascorbic acid compound of formula (II) are given below although the invention is not limited thereto.

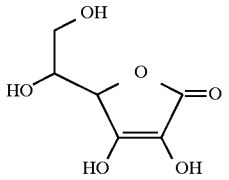

A-1

-continued
A-2
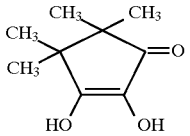
A-3
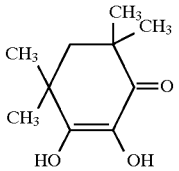
A-4
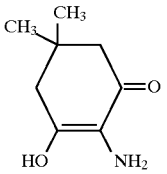
A-5
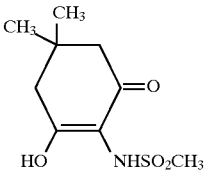
A-6
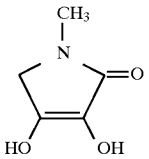
A-7
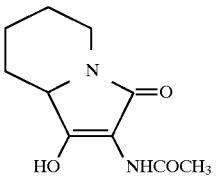
A-8
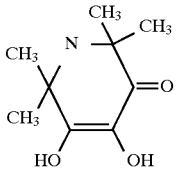
A-9
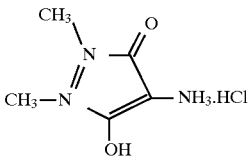
A-10
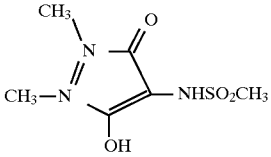
-continued
A-11
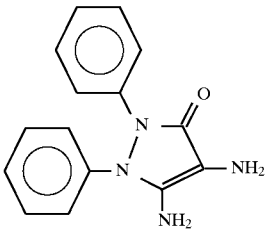
A-12
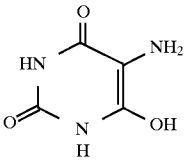
A-13
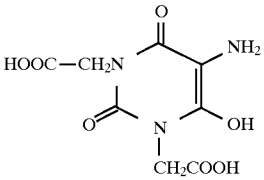
A-14
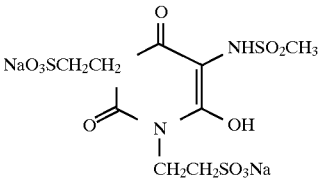
A-15
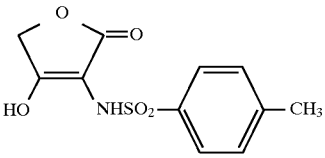
A-16
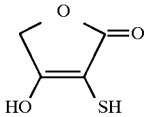
A-17
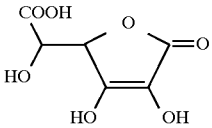
A-18
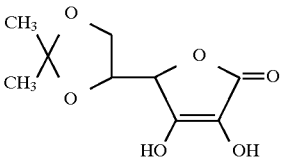
A-19
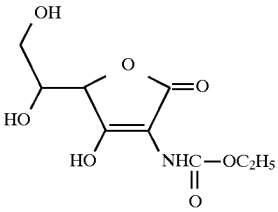

-continued

A-20

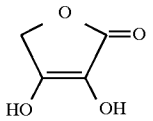

A-21

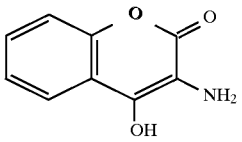

A-22

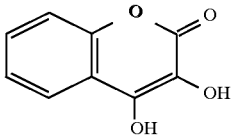

A-23

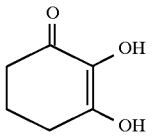

A-24

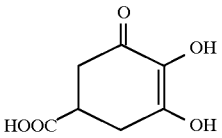

A-25

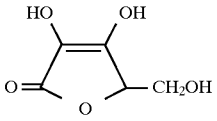

A-26

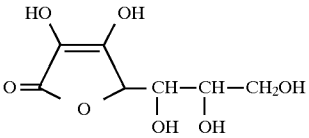

A-27

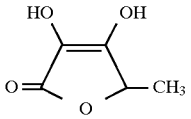

A-28

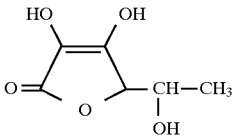

A-29

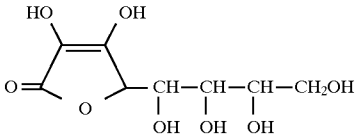

A-30

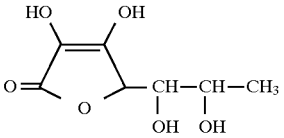

-continued

A-31

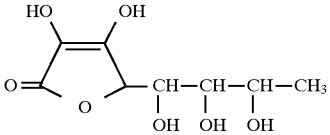

A-32

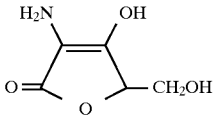

A-33

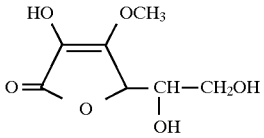

A-34

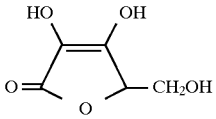

A-35

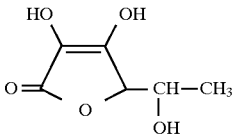

Among the ascorbic acid compounds used in the developer according to the invention, compounds of endiol, enamionol, endiamin, thiol-enol and enamin-thiol types are generally well known. Exemplary compounds are described in U.S. Pat. No. 2,688,549 and JP-A 237443/1987. Synthesis of these ascorbic acid compounds is also well known as described in NOMURA Tsugio and KIMURA Hirohisa, "Chemistry of Reductants," Uchida-Rokakuho-Shinsha, 1969.

In the practice of the invention, the ascorbic acid compounds may be used in the form of alkali metal salts such as lithium, sodium and potassium salts. The ascorbic acid compounds may be used in the developer of the invention either as a developing agent or as a preservative and either alone or in admixture of two or more. The ascorbic acid compounds are preferably used in amounts of 0.01 to 110 grams, more preferably 0.1 to 100 grams, further preferably 1 to 100 grams, most preferably 5 to 80 grams per liter of a developer solution to be prepared according to the invention or ready-to-use solution.

In the developer of the invention, a developing agent other than the ascorbic acid may be used. Exemplary developing agents are dihydroxybenzenes. The dihydroxybenzenes include hydroquinone, chlorohydroquinone, and methylhydroquinone, with hydroquinone being especially preferred. The dihydroxybenzenes are preferably used in amounts of 0.01 to 1.2 mol per liter of the developer solution or ready-to-use solution.

The developer of the invention may further contain an auxiliary developing agent having superadditivity. The auxiliary developing agent may be selected from 3-pyrazolidone and p-aminophenol derivatives commonly used as the developing agent. The term "superadditivity" means that when two developing agents are used, the total rate of development is greater than the sum of the individual rates as described in T. H. James, "The Theory of the Photographic Process," 4-th Ed., page 432.

Non-limiting examples of the 3-pyrazolidone developing agent used herein include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-amino-phenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone. The 3-pyrazolidones may be used alone or in admixture of two or more. These auxiliary developing agents are preferably used in amounts of $10^{-4}$ to $10^{-1}$ mol, more preferably $5\times10^{-4}$ to $5\times10^{-2}$ mol per liter of the developer solution or ready-to-use solution.

Examples of the p-aminophenol developing agent used herein include p-aminophenol, N-methyl-p-aminophenol, N-(β-hydroxyethyl)-p-aminophenol, N-(4-hydroxyphenyl) glycine, 2-methyl-p-aminophenol, and p-benzylaminophenol, with the N-methyl-p-aminophenol being preferred. These auxiliary developing agents are preferably used in the developer solution in amounts of about $10^{-4}$ to $10^{-1}$ mol/liter.

In the practice of the invention, a mixture of a 3-pyrazolidone developing agent and a p-aminophenol developing agent may be used, preferably in a total amount of $10^{-4}$ to $10^{-1}$ mol per liter of the developer solution or ready-to-use solution.

The amount of the auxiliary developing agent exhibiting superadditivity used is preferably 1 to 50 mol %, especially 2 to 25 mol % based on the developing agent. Within this range, the auxiliary developing agent exerts superadditivity to a full extent. Lesser amounts would be ineffective whereas excessive amounts are undesirable from the standpoints of cost and solubility limit.

Sulfites may be used in the developer of the invention as a preservative. Examples of the sulfite preservative include sodium sulfite, potassium sulfite, lithium sulfite, ammonium sulfite, sodium bisulfite, potassium metabisulfite, and formaldehyde sodium bisulfite. The sulfite is preferably used in an amount of about 0.01 to 2.5 mol, more preferably about 0.03 to 1.2 mol per liter of the developer solution or ready-to-use solution.

For accelerating development, the developer of the invention may further contain compounds as disclosed in U.S. Pat. No. 5,474,879. There may also be contained amino compounds, for example, those disclosed in JP-A 106244/1981 and 267759/1986 and Japanese Patent Application No. 29418/1989.

The developer solution or ready-to-use solution prepared from the inventive developer is preferably adjusted to pH 8.5 to 12.0, more preferably pH 9 to 11.0.

An alkaline agent is used for pH adjustment. The alkaline agents are usually water-soluble inorganic alkali metal salts such as sodium hydroxide, potassium hydroxide, sodium carbonate, sodium hydrogen carbonate, potassium carbonate, and potassium hydrogen carbonate. Particularly when the developer of the invention contains an ascorbic acid as a developing agent, the carbonate is preferably used in an amount of at least 0.3 mol, especially 0.4 to about 1.0 mol per liter of the developer solution or ready-to-use solution. The alkaline agent is preferably used in an amount of about 0.3 to about 1.0 mol per liter of the developer solution.

In the liquid developer of the invention, there may be added pH buffers such as disodium phosphate, dipotassium phosphate, monosodium phosphate, and monopotassium phosphate as well as pH buffers as disclosed in JP-A 93433/1985. Other useful additives include development restrainers such as potassium bromide and potassium iodide; organic solvents such as dimethylformamide, methyl cellosolve, hexylene glycol, ethanol, and methanol; benzotriazoles such as 5-methylbenzotriazole, 5-bromobenzotriazole, 5-chlorobenzotriazole, 5-butylbenzotriazole, and benzotriazole (the 5-methylbenzotriazole being preferred); and nitroindazoles such as 5-nitroindazole, 6-nitroindazole, 4-nitroindazole, 7-nitroindazole, and 3-cyano-5-nitroindazole.

Although boron compounds such as boric acid and borax are often used in conventional developers as a pH buffer, it is preferred that the developer of the invention containing an ascorbic acid as the developing agent is substantially free of boron compounds.

Color toning agents, surfactants, water softeners, and hardening agents are also contained if desired. The color toning agents include the compounds described in Japanese Patent Application No. 176909/1995.

Chelating agents may be contained in the developer of the invention. Exemplary chelating agents include ethylenediaminediorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3-diaminopropanoltetraacetic acid, triethylenetetraminehexaacetic acid, trans-cyclohexanediaminetetraacetic acid, ethylenediaminetetraacetic acid, glycol ether diamine tetraacetic acid, ethylenediaminetetrakismethylenephosphonic acid, diethylenetriaminepentamethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,3,3-tricarboxylic acid, catechol-3,5-disulfonic acid, sodium pyrophosphate, sodium tetrapolyphosphate, and sodium hexametaphosphate. Especially preferred are diethylenetriaminepentaacetic acid, triethylenetetraminehexaacetic acid, 1,3-diaminopropanoltetraacetic acid, glycol ether diamine tetraacetic acid, hydroxyethylethylenediaminetriacetic acid, 2-phosphonobutane-1,2,4-tricarboxylic acid, 1,1-diphosphonoethane-2-carboxylic acid, nitrilotrimethylenephosphonic acid, ethylenediaminetetraphosphonic acid, diethylenetriaminepentaphosphonic acid, 1-hydroxypropylidene-1,1-diphosphonic acid, 1-aminoethylidene-1,1-diphosphonic acid, 1-hydroxyethylidene-1,1-diphosphonic acid, and salts thereof.

An anti-sludging agent may be contained in the developer of the invention. Use may be made of the compounds described in JP-B 46585/1981, 4702/1987, and 4703/1987, U.S. Pat. Nos. 4,254,215 and 3,318,701, JP-A 203439/1983, 56959/1987, 178247/1987, 200249/1989, 362942/1992, 303179/1993, and 53257/1993, and Japanese Patent Application No. 104805/1995.

Dialdehyde compounds or bisulfite addition products thereof may be contained in the developer of the invention as a hardener. Examples include glutaraldehyde, α-methylglutaraldehyde, β-methylglutaraldehyde, maleindialdehyde, succindialdehyde, methoxysuccindialdehyde, methylsuccindialdehyde, α-methoxy-β-ethoxyglutaraldehyde, α-n-butoxyglutaraldehyde, α,α-dimethoxysuccindialdehyde, β-isopropylsuccindialdehyde, α,α-diethylsuccindialdehyde, butylmaleindialdehyde, and bisulfite addition products thereof. The dialdehyde compound is used in such an amount that the photographic layer to be processed with the developer may not be reduced in sensitivity and the drying time not be substantially extended. For instance, the dialdehyde compound is used in an amount of about 1 to 50 grams, preferably 3 to 10 grams per liter of the developer solution or ready-to-use solution. Glutaraldehyde and bisulfite addition products thereof are most commonly used among others. It is noted that when a bisulfite addition product of dialdehyde hardener is used, the bisulfite added to this hardener is also calculated as the sulfite in the developer.

Also useful are those compounds described in L.F.A. Mason, "Photographic Processing Chemistry," Focal Press (1966), pp. 226–229, U.S. Pat. Nos. 2,193,015 and 2,592,364, and JP-A 64933/1973.

The developer of the invention is preferably prepared in solution form by the methods described in JP-A 177132/1986, 134666/1991, and 67258/1991.

For storage, the developer of the invention is preferably contained in a container of a packaging material having low oxygen permeability. The oxygen permeability used herein is as measured in accordance with JIS K7126-1992 at 20° C. and RH 65%. Preferably the packaging material has an oxygen permeability of up to 50 ml/m$^2$·24 hr·atm, more preferably 0 to 50 ml/m$^2$·24 hr·atm, further preferably 0 to 20 ml/m$^2$·24 hr·atm, most preferably 0 to 10 ml/m$^2$·24 hr·atm at 20° C. and RH 65%.

Such packaging materials are typically plastic packaging materials, for example, films of polyvinylidene chloride, nylon (NY), saponified ethylene-vinyl acetate copolymers (commercially available as EVAL®), polyvinyl alcohol (commercially available as Vinylon), polyvinyl chloride, aluminum foil laminated films, and metallized films (typically aluminized films) alone or in combination. Also useful are composite films comprising a substrate of polyethylene (PE) or ethylene-vinyl acetate copolymer (EVA) to which a plastic film as mentioned above is attached. A desired oxygen permeability may be obtained by increasing the gage of polyethylene or analogous films. These plastic packaging materials may be configured into containers of any desired shape including bottles, containers of cubic type and containers of overlap pillow type. The bottles and containers of cubic type may be prepared by co-extruding plastic materials having low oxygen permeability as a laminate.

Among the above-mentioned packaging materials, polyvinylidene chloride, nylon, and saponified ethylene-vinyl acetate copolymers are preferred because of low oxygen permeability, strength as shaped into containers, and ease of shaping into containers.

The packaging material is molded or otherwise shaped into containers which preferably have a (total) wall gage of about 20 to 2,000 μm, more preferably 50 to 1,000 μm.

Described below are exemplary containers of the pillow and cubic types into which the above-mentioned packaging materials are shaped.

1) Pillow type (oxygen permeability 5 ml/m$^2$·24 hr·atm)

A composite film of three layers EVAL®/NY/PE (20/15/55 μm) is placed on a film of EVA (80 μm) to form a two-ply structure.

2) Cubic type (oxygen permeability 20 ml/m$^2$·24 hr·atm)

A composite film consists of two layers NY/PE (75/175

Another useful packaging material is a flexible composite film obtained by overlying on an inner film having low oxygen permeability an outer film having a water permeability higher than that of the inner film by a factor of 1.5 to 100. This composite film can be shaped into containers of any desired shape. The inner film preferably has a water permeability (also known as moisture permeability) of 0 to 2 ml/m$^2$·24 hr·atm, more preferably 0 to 1 ml/m$^2$·24 hr·atm as measured at 40° C. and RH 90% in accordance with JIS K7129-1992. The outer film preferably has a water permeability higher than that of the inner film by a factor of 2 to 50, more preferably 2 to 30. Design parameters within this range eliminate any volume increase probably due to the accumulation of gas between the inner and outer films when a container is stored at elevated temperatures.

A flexible composite film having oxygen permeability and water permeability in a desired range can be prepared by properly combining very large density polyethylene (VLDPE), linear low density polyethylene (LLDPE), antiblocking agent (AB) and special NY as stock material and determining a suitable gage for respective films.

An outer film having higher oxygen permeability and water permeability than the inner film may be prepared by selecting a stock material from low density polyethylene (LDPE), rubber AB, and 6NY and determining a proper gage.

A packaging container is prepared from a flexible composite film consisting of inner and outer films as mentioned above. The flexible composite film used herein may have a gage of 1 mm or more although a gage of about 20 to 500 μm, more preferably 30 to 250 μm, most preferably 70 to 150 μm is preferred. The flexible composite film used herein is defined as follows. A film strip of 20 cm long and 2 cm wide is rested on a horizontal desk. The film strip is longitudinally moved so that it projects 10 cm from one end of the horizontal desk and its free end sags. When the sagging free end of the film strip is apart from the horizontal plane of the desk by a vertical distance of at least 2 cm, preferably at least 3 cm, more preferably at least 5 cm, this film is regarded flexible.

Examples of the flexible composite film include K coat oriented polypropylene (KOP)/NY/polyethylene (PE) (K coat designates vinylidene chloride coat), PE/K coat nylon (KNY)/polyethylene terephthalate (PET), oriented polypropylene (OPP)/silica-laden polyethylene terephthalate (SiOx·PET)/PE, alumina-laden polyethylene terephthalate ($Al_2O_3$·PET)/NY/non-oriented polypropylene (CPP), and polypropylene (PP)/ethylene-vinyl alcohol copolymer (EVOH)/PE.

From the environmental consideration, metal-free materials, low combustion calorie materials and decomposable materials are desirable. For example, the combustion calorie of PE can be reduced by adding 10 to 50% by weight of $CaCO_3$ to PE or converting PE into polyethylene terephthalate (A-PET). Films which are decomposable after use may be prepared from naturally occurring polymers such as starch, cellulose and chitosan, microbial polymers using polyesters produced by microorganisms such as hydrogen bacteria and blue-green algae, and synthetic polymers, for example, aliphatic polyesters such as polylactic acid-polycaprolactone (PCL). Blends of a polyolefin resin and a decomposition promoter such as starch are also useful. From the standpoint of recycle use, a material consisting of fewer components, desirably a single component is important.

Composite films are not limited to the above-mentioned examples and stock materials may be selected in any desired combination of type and gage in accordance with a functional, economical and/or environmental consideration.

The developer of the invention may be used as a processing solution after or without diluting by a factor of about 2 or 3.

Typically, the developer of the invention is diluted into a developer solution, with which a photographic silver halide photosensitive material is processed. The photosensitive material should include at least one layer of a silver halide emulsion containing at least 50%, preferably 60 to 90%, based on the projected area of entire silver halide grains, of tabular silver halide grains having an aspect ratio of at least 3.0. The inclusion of such an emulsion layer ensures high sensitivity. A silver halide emulsion containing less than 50% of tabular grains is low in sensitivity. The photosensitive material should have a swelling factor of 130 to 250%.

Such photographic silver halide photosensitive materials are typically black-and-white photosensitive materials. Exemplary photographic materials include medical direct or indirect radiography X-ray-sensitive materials, medical CRT image recording photosensitive materials, industrial X-ray photographic materials, X-ray dupe photographic materials, and ultrahigh contrast photographic materials for graphic art. In this regard, reference is made to JP-A 136043/1988, 107442/1992, 328737/1992, 72679/1993, 232639/1993, 13306/1995, 77781/1995, and 84343/1995.

The photosensitive material including a silver halide emulsion layer containing tabular silver halide grains having an aspect ratio of at least 3.0 is described below. The aspect ratio is a ratio of diameter to thickness. The tabular grains in emulsion should preferably have a diameter of 0.2 to 2.0 $\mu$m, more preferably 0.5 to 1.5 $\mu$m as converted into spherical grains having the same volume. Tabular grains having an aspect ratio of 3/1 to 15/1 are preferably used. In this regard, reference is made to Research Disclosure, Vol. 225, Item 22534, pages 20–58, January 1983 and JP-A 127921/1983 and 113926/1983. Tabular silver halide grains may be prepared by a proper combination of well-known techniques. Tabular silver halide emulsions can be readily prepared by methods as disclosed in JP-A 127921/1983, 113927/1983, and 113928/1983, and U.S. Pat. No. 4,439,520.

To take further advantage of the invention, a selenium sensitizer is preferably used in the emulsion. The selenium sensitizer used herein may be selected from well-known selenium compounds disclosed in patents. Useful non-unstable selenium compounds are disclosed in JP-B 4553/1971, 34492/1977, and 34491/1977. Typical non-unstable selenium compounds are selenious acid, potassium selenocyanide, selenazoles, quaternary salts of selenazoles, diaryl selenides, diaryl diselenides, dialkyl selenides, dialkyl diselenides, 2-selenazolidinedione, 2-selenoxazolidinethion and derivatives thereof.

A silver halide solvent can be used herein. Examples include (a) organic thioether compounds as disclosed in U.S. Pat. Nos. 3,271,157, 3,531,289, and 3,574,628, JP-A 1019/1979 and 158917/1979; (b) thiourea compounds as disclosed in JP-A 82408/1978, 77737/1980, and 2982/1980; (c) silver halide solvents having a thiocarbonyl group intervening between an oxygen or sulfur atom and a nitrogen atom as disclosed in JP-A 144319/1978; (d) imidazoles as disclosed in JP-A 100717/1979; (e) sulfites; and (f) thiocyanates. The thiocyanates and tetramethylthiourea are especially preferred solvents. The amount of the solvent used varies with a particular type. For example, thiocyanates are preferably used in amounts of $1\times10^{-4}$ to $1\times10^{-2}$ mol per mol of silver halide.

The photographic silver halide emulsion to be developed with the developer of the invention is subject to chemical sensitization. Higher sensitivity and lower fog are achieved by employing sulfur sensitization and/or gold sensitization. Sulfur sensitization is generally carried out by adding a sulfur sensitizer to the emulsion and agitating the emulsion at an elevated temperature, preferably above 40° C. for a certain time. Gold sensitization is generally carried out by adding a gold sensitizer to the emulsion and agitating the emulsion at an elevated temperature, preferably above 40° C. for a certain time. For the sulfur sensitization, any of well-known sulfur sensitizers may be used. Included are thiosulfates, thioureas, allylisothiacyanates, cystine, p-toluenethiosulfonates, and rhodanine. Other useful sulfur sensitizers are described in U.S. Pat. Nos. 1,574,944, 2,410,689, 2,278,947, 2,728,668, 3,501,313, and 3,656,955, German Patent No. 14 22 869, JP-B 24937/1981, and JP-A 45016/1980. The sulfur sensitizer may be added in a sufficient amount to effectively increase the sensitivity of the emulsion. This amount varies with various conditions including pH, temperature, and silver halide grain size although it is preferably $1\times10^{-7}$ to $5\times10^{-4}$ mol per mol of the silver halide.

For the gold sensitization, there may be used any of gold sensitizers whose gold may have an oxidation number of +1 or +3. Conventional gold sensitizers are useful. Typical examples include chloroaurates such as potassium chloroaurate, auric trichloride, potassium auric thiocyanate, potassium iodoaurate, tetracyanoauric acid, ammonium aurothiocyanate, and pyridyl trichlorogold. The amount of the gold sensitizer added varies with various conditions although it is typically $1\times10^{-7}$ to $5\times10^{-4}$ mol per mol of the silver halide.

To take further advantage of the invention, a silver halide-adsorbing material is preferably present in an amount of at least 0.5 mmol per mol of the silver halide during chemical sensitization in an emulsion preparing process as disclosed in JP-A 68539/1990. The silver halide-adsorbing material may be added at any stage, for example, during grain formation, immediately after grain formation, before or after the start of post-ripening, preferably before or simultaneously with the addition of a chemical sensitizer (e.g., gold or sulfur sensitizer). It is required that the silver halide-adsorbing material be present at least during the progress of chemical sensitization. As to the conditions under which the silver halide adsorbing material is added, the temperature may be selected in the range of 30° to 80° C. although the range of 50° to 80° C. is preferred for enhancing adsorption. No particular limit is imposed on pH and pAg although the emulsion is preferably at pH 5 to 10 and pAg 7 to 9 when chemical sensitization is carried out.

The silver halide-adsorbing material used herein encompasses sensitizing dyes and photographic performance stabilizers. Included are a number of compounds known as antifogging agents and stabilizers, for example, azoles such as benzothiazolium salts, benzoimidazolium salts, imidazoles, benzimidazoles, nitroindazoles, triazoles, benzotriazoles, tetrazoles, and triazines; mercapto compounds such as mercaptothiazoles, mercaptobenzothiazoles, mercaptoimidazoles, mercaptobenzimidazoles, mercaptobenzoxazoles, mercaptothiadiazoles, mercaptooxadiazoles, mercaptotetrazoles, mercaptopyrimidines, and mercaptotriazines; thioketones such as oxazoline thion; and azaindenes such as triazaindenes, tetraazaindenes (especially 4-hydroxy-substituted 1,3,3a,7-tetraazaindenes), and pentaazaindenes. Other useful silver halide-adsorbing materials are purins and nucleic acids, and high-molecular weight compounds as disclosed in JP-B 36213/1986 and JP-A 90844/1984.

Sensitizing dyes are also effective as the silver halide-adsorbing material. Exemplary sensitizing dyes include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes used herein are described, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, 2,503,776, JP-A 76525/1973, and Belgian Patent No. 691807.

In a photographic emulsion layer or another hydrophilic colloidal layer of the photosensitive material to be developed with the developer of the invention, there may be contained various surfactants for the purposes of coating assistance, antistatic, sliding modification, emulsification and dispersion, anti-adhesion and improving photographic characteristics (e.g., development promotion, hardening and sensitization).

Gelatin is advantageously used as a binder or protective colloid in emulsion layers, intermediate layer and surface protective layer of the photosensitive material although other hydrophilic colloids are also useful. Useful are gelatin derivatives, graft polymers of gelatin with other polymers, proteins such as albumin and casein; cellulose derivatives such as hydroxyethyl cellulose, carboxymethyl cellulose and cellulose sulfate ester, sodium alginate, sucrose derivatives such as dextran and starch derivatives; and various other synthetic hydrophilic polymers such as polyvinyl alcohol, polyvinyl alcohol partial acetal, poly-N-vinyl pyrrolidone, polyacrylic acid, polymethacrylic acid, polyacrylamide, polyvinylimidazole, and polyvinylpyrazole, alone or copolymers thereof. Examples of the gelatin used include lime treated gelatin, acid treated gelatin, and enzyme treated gelatin as well as hydrolyzed and enzymatically decomposed products of gelatin. It is preferred to use dextran and polyacrylamide having an average molecular weight of up to 50,000 in combination with gelatin. The methods described in JP-A 68837/1988 and 149641/1988 are also useful in the practice of the invention.

An inorganic or organic hardener may be contained in the photographic emulsion or non-photosensitive hydrophilic colloid. Exemplary hardeners include chromium salts such as chromium alum and chromium acetate; aldehydes such as formaldehyde, glyoxal, and glutaraldehyde; N-methylol compounds such as dimethylol urea and methylol dimethyl hydantoin; dioxane derivatives such as 2,3-dihydroxydioxane; active vinyl compounds such as 1,3,5-triacryloyl-hexahydro-s-triazine, bis(vinylsulfonyl)methyl ether, and N,N'-methylenebis-[β-(vinylsulfonyl) propionamide]; active halogen compounds such as 2,4-dichloro-6-hydroxy-s-triazine; mucohalogenic acids such as mucochloric acid and mucophenoxychloric acid; isooxazoles, dialdehyde starch, and 2-chloro-6-hydroxytriazinyl gelatin, alone or in admixture. Preferred among others are the active vinyl compounds described in JP-A 41221/1978, 57257/1978, 162546/1984, and 80846/1985 and the active halogen compounds described in U.S. Pat. No. 3,325,287.

Preferably the hydrophilic colloid layer of the photographic photosensitive material is hardened with a hardener as mentioned above to a swelling factor in water of 130% to 250%. Note that the swelling factor in water is measured by a freeze dry method as follows. The photographic material is allowed to stand for 7 days at 25° C. and RH 60% before the swelling factor of the hydrophilic colloid layer is measured. The thickness (a) of a dry film is determined by observing a cut section under a scanning electron microscope (SEM). The thickness (b) of a swollen film is determined by dipping the photographic material in distilled water at 21° C. for 3 minutes, freeze drying it with liquefied nitrogen, and observing it under SEM. The swelling factor is calculated in accordance with $(b-a)/a\times100\%$. Higher sensitivity is obtained with a swelling factor of 150 to 230%. Photosensitive material with a swelling factor of less than 130% is low in sensitivity. Photosensitive material with a swelling factor of more than 250% is not practical in drying because the film can be damaged.

In the emulsion layer of the photographic photosensitive material, there may be contained plasticizers for polymers and emulsified products for improving pressure characteristics. Use may be made of the heterocyclic compounds disclosed in UK Patent No. 738,618, alkyl phthalates disclosed in UK Patent No. 738,637, alkyl esters disclosed in UK Patent No. 738,639, polyhydric alcohols disclosed in U.S. Pat. No. 2,960,404, carboxyalkyl celluloses disclosed in U.S. Pat. No. 3,121,060, paraffins and carboxylates disclosed in JP-A 5017/1974, and alkyl acrylates and organic acids disclosed in JP-A 28086/1978. No particular limit is imposed on the other features of the emulsion layer of the photographic silver halide photosensitive material to be developed according to the invention. Various additives may be added to the emulsion layer if necessary. Exemplary additives are binders, surfactants, dyes, coating aids, and thickeners as disclosed in Research Disclosure, Vol. 176, pages 22–28 (December 1978).

A photographic silver halide photosensitive material having a photographic emulsion layer on either surface has the problem that crossover light can cause deterioration of image quality. The crossover light used herein is the visible light which is released from sensitizing screens disposed on opposite sides of the photosensitive material and transmitted by the support of the photosensitive material (which is generally as thick as about 170 to 180 μm) to opposite photosensitive layers to cause a lowering of image quality (especially sharpness). The lesser the crossover, the sharper becomes the image. Various methods are available for reducing the crossover. One preferred method is by fixing between the support and the photosensitive layer a dye which is decolorable by development processing. Use of a microcrystalline dye as taught in U.S. Pat. No. 4,803,150 is advantageous for reducing the crossover because its fixation and decoloring are effective and a relatively large amount of the dye can be contained. This method can reduce the crossover to 15% or less because there occurs no desensitization due to short fixation and decoloring of the dye is possible even on rapid processing.

For reduced crossover, the dye layer should preferably have the dye distributed in as high a concentration as possible. It is preferred to form the dye layer to a thickness of 0.5 μm or less by reducing the coverage of gelatin used as a binder. Since an extremely thin layer tends to be short of adhesion, the dye layer should most preferably have a thickness of 0.05 to 0.3 μm.

The emulsion for use in the photographic silver halide photosensitive material used herein, for example, silver chloride, silver chlorobromide, silver bromide or silver chloroiodobromide emulsion may be prepared by any conventional technique as disclosed in P. Glafkides, "Chimie et Physique Photographique", Paul Montel (1967), G. F. Duffin, "Photographic Emulsion Chemistry", Focal Press (1966), and V. L, Zelikman et al., "Making and Coating Photographic Emulsion", Focal Press (1964). More particularly, acidic, neutral and ammonia methods may be used although the acidic and neutral methods are preferred for reduced fog. The mode of reacting a soluble silver salt with a soluble halide may be single jet, double jet or a combination thereof. It is also employable to form grains in the presence of excess silver, which is known as reverse mixing method. The double jet technique is preferred for preparing an emulsion of monodisperse grains which is useful in the invention. One special type of the double jet technique is by maintaining constant the pAg of a liquid phase in which silver halide is created, which is known as a controlled double jet technique. This technique results in a silver halide emulsion of grains having a regular crystalline form and a narrow grain size distribution.

High silver chloride grains are formed, preferably by methods using bispyridinium compounds as disclosed in JP-A 32/1990, 137632/1991, 6546/1992, 127279/1993, and 53231/1993 as well as methods as disclosed in JP-A 293536/1987, 155332/1989, 2043/1988, and 25643/1988, U.S. Pat. Nos. 4,400,463 and 5,061,617.

In the step of forming or physical ripening silver halide grains, any desired salt may coexist, for example, cadmium salts, zinc salts, lead salts, thallium salts, iridium salts or complex salts, rhodium salts or complex salts, and iron salts or complex salts.

Silver halide solvents may be used during or after preparation of silver halide grains. Known examples of the silver halide solvent include ammonia, thiocyanates, thioether compounds as disclosed in, for example, U.S. Pat. No. 3,271,157, JP-A 12360/1976, 82408/1978, 144319/1978, 100717/1979, and 155828/1979, and thion compounds. The above-mentioned method combined with the addition of the silver halide solvent results in an emulsion of silver halide grains having a regular crystalline form and a narrow grain size distribution.

Additionally, in the black-and-white photosensitive material, the hydrophilic colloid layer may contain a water soluble dye as a filter dye or for the purposes of preventing irradiation. Exemplary dyes are oxonol dyes, hemioxonol dyes, styryl dyes, merocyanine dyes, cyanine dyes, and azo dyes, with the oxonol, hemioxonol and merocyanine dyes being preferred.

The support of the photographic photosensitive material should have a thickness of 150 to 250 $\mu$m. This range of thickness is necessary from the standpoint of manual handling upon viewing on a medical view box. The support is typically polyethylene terephthalate film which is preferably tinted blue. For increasing the adhesion of the support to the hydrophilic colloid layer, the support on its surface is often subject to a corona discharge treatment, glow discharge treatment or UV exposure treatment. Alternatively, the support may be provided with an undercoat layer of a styrene-butadiene latex, vinylidene chloride latex or the like and further with a gelatin layer thereon.

An undercoat layer may also be formed from a composition containing a polyethylene swelling agent and gelatin in an organic solvent. These undercoat layers may be further modified to increase their adhesion to the hydrophilic colloid layer by carrying out surface treatment.

Various methods and additives which can be used in the photographic photosensitive material are shown below by referring to the teaching patent references.

1) Chemical sensitizing method

JP-A 68539/1990, page 10, upper-right column, line 13 to upper-left column, line 16 and JP-A 313282/1993

2) Antifoggant & stabilizer

JP-A 68539/1990, page 10, lower-left column, line 17 to page 11, upper-left column, line 7 and page 3, lower-left column, line 2 to page 4, lower-left column 3) Tone modifier JP-A 276539/1987, page 2, lower-left column, line 7 to page 10, lower-left column, line 20 and JP-A 94249/1991, page 6, lower-left column, line 15 to page 11, upper-right column, line 19

4) Surfactant & antistatic agent

JP-A 68539/1990, page 11, upper-left column, line 14 to page 12, upper-left column, line 9

5) Matting agent, lubricating agent & plasticizer

JP-A 68539/1990, page 12, upper-left column, line 10 to upper-right column, line 10 and page 14, lower-left column, line 10 to lower-right column, line 1

6) Hydrophilic colloid

JP-A 68539/1990, page 12, upper-right column, line 11 to lower-left column, line 16

7) Hardener

JP-A 68539/1990, page 12, lower-left column, line 17 to page 13, upper-right column, line 6

8) Polyhydroxybenzene

JP-A 39948/1991, page 11, upper-left column to page 12, lower-left column and EP 452772 A 9) Layer arrangement

JP-A 198041/1991

In the practice of the invention, a developing solution which is prepared from the developer of the invention is replenished in accordance with the method described in JP-A 216180/1993, preferably in an amount of up to 250 ml per square meter of silver halide photosensitive material being developed. The replenishing amount is more preferably 50 to 250 ml/m$^2$, most preferably 100 to 200 ml/m$^2$.

After silver halide photosensitive material is developed with a developing solution prepared from the developer of the invention, it is generally subject to fixation, water rinsing and/or stabilizing treatment.

A fixer is used in the fixation step. It is an aqueous solution containing a thiosulfate or meso-ionic compound as a fixing agent and adjusted to pH 3.8 or higher, preferably pH 4.2 to 6.0. Examples of the thiosulfate include sodium thiosulfate and ammonium thiosulfate. The fixing agent is contained in any suitable amount. The fixer may further contain a water-soluble aluminum salt serving as a hardening agent, for example, aluminum chloride, aluminum sulfate and potassium alum. In the fixer, tartaric acid, citric acid, gluconic acid and derivatives thereof may be contained alone or in admixture of two or more. These compounds are preferably added in amounts of at least 0.005 mol, especially 0.01 to 0.03 mol per liter of the fixer solution.

If desired, the fixer may further contain preservatives such as sulfites and bisulfites, pH buffers such as acetic acid and boric acid, pH adjusting agents such as sulfuric acid, chelating agents capable of softening hard water, and compounds as described in JP-A 78551/1987.

For the fixer solution, there may be used commercially available ones, for example, Fuji-F, CE-F1, CE-F2, RF-10, HiRen-Fix, and GR-F1 from Fuji Photo-Film Co., Ltd.

The fixer solution may be replenished in an amount of 50 to 350 ml/m$^2$, more preferably 90 to 300 ml/m$^2$ of silver halide photosensitive material.

For promoting fixation, the fixing step may be carried out by the methods described in JP-A 4739/1989 and 101728/1991.

According to the above-mentioned process, the photosensitive material which has been developed and fixed is treated with washing water or stabilizing solution and then dried.

For the processing of silver halide photosensitive material, an automatic processing machine is often used. It may be of the roller conveyor or belt conveyor system. An automatic processor of the roller conveyor type is preferred. An automatic processor including a developing tank having a reduced aperture (which is an area of the surface of the developing solution in contact with air in the developing tank per tank volume) as disclosed in JP-A 166040/1989 and 193853/1989 is especially preferred because air oxidation and evaporation are minimized. In such a processor, photosensitive material is passed between squeeze rollers for squeezing off washing water before drying.

Washing water is preferably passed through a filter member or filter layer of activated carbon for removing foreign matter and organic matter before it is supplied into the washing tank.

To washing water are applied various anti-bacterial means. The known anti-bacterial means includes irradiation of ultraviolet radiation as disclosed in JP-A 263939/1985; application of a magnetic field as disclosed in JP-A 263940/1985; the use of ion-exchange resins to purify water as disclosed in JP-A 131632/1986; blowing of ozone and circulation through a filter and adsorbent column as described in Japanese Patent Application Nos. 208638/1990 and 303055/1990; bacterial decomposition as described in Japanese Patent Application No. 24138/1991; and anti-bacterial agents as disclosed in JP-A 115154/1987, 153952/1987, 220951/1987 and 209532/1987. Also useful are anti-fungal agents, anti-bacterial agents and surfactants as described in M. W. Beach, "Microbiological Growths in Motion-Picture Processing", SMPTE Journal, Vol. 85 (1976); R. O. Deegan, "Photo Processing Wash Water Biocides", J. Imaging Tech., 10, No. 6 (1984); and JP-A 8542/1982, 58143/1982, 97530/1982, 132146/1982, 257244/1982, 18631/1983, and 105145/1983.

In the washing or stabilizing bath, there may be optionally added as a microbiocide the isothiazolines described in R. T. Kreiman, J. Image, Tech 10 (6), 242 (1984), bromochlorodimethylhydantoin, the isothiazolines described in Research Disclosure, Vol. 205, No. 20526 (May 1981) and Vol. 228, No. 22845 (April 1983), and the compounds described in JP-A 209532/1987. Other useful compounds are described in HORIGUCHI Hiroshi, "Bokin Bobai no Kagaku (Antibacterial and Antifungal Chemistry) ", Sankyo Publishing K.K., 1982, and Nippon Bokin Bobai Society, "Bokin Bobai Gijutu Handbook (Antibacterial & Antifungal Engineering Handbook)", Hakuhodo K. K., 1986.

After development, fixation, and water washing (or stabilization), the silver halide photosensitive material is passed between squeeze rollers for squeezing off washing water and then dried. Drying is done at a temperature of about 40° to 100° C. The drying time is variable depending on various conditions although a time of about 5 seconds to about 3 minutes is commonly used. Drying is preferably done at 40° to 80° C. for about 5 seconds to about 2 minutes. Also drying may be done in a drying section where a heater at a temperature of higher than 90° C. (usually lower than 120° C.) or a radiant source at a temperature of higher than 150° C. (usually lower than 500° C.) is located as disclosed in JP-A 173279/1993, 159550/1992, and 253855/1991.

Various modifications may be made to the above-mentioned process in order to complete processing of photosensitive material within 100 seconds on a dry-to-dry basis. Such modifications include the use of rubbery material rollers in the developing tank as outlet rollers to prevent uneven development inherent to rapid processing as described in JP-A 151943/1988; a developer jet flow in the developing tank at a flow speed of at least 10 m/min. for agitating the developer therein as described in JP-A 151944/1988; and more rigorous agitation during development than in standby periods as described in JP-A 264758/1988.

As the automatic processor suitable for development using the developer according to the invention, there may be used processors FPM-9000, CEPROS-M2, CEPROS-30, CEPROS-S, FPM-800A, and FL-IMD commercially available from Fuji Photo-Film Co. Ltd.

Preferred embodiments of the developer of the invention and a processing method using the same are described below.

(1) A method for processing a photographic silver halide photosensitive material with a developer wherein a developer solution is prepared from the developer which is a one-part concentrate.

(2) A method for processing a photographic silver halide photosensitive material according to (1) wherein the developer solution contains at least 80 mol %, preferably 80 to 98 mol % of potassium ion based on entire cations.

(3) A method for processing a photographic silver halide photosensitive material with a developer wherein the photosensitive material having silver coated on each side thereof in a coverage of up to 3.5 g/m$^2$, preferably 0.1 to 3.5 g/m$^2$.

(4) A method for processing a photographic silver halide photosensitive material with a developer wherein the photosensitive material comprising silver halide grains containing 10 to 100 mol % of silver chloride, 0 to 100 mol % of silver bromide, and 0 to 5 mol % of silver iodide.

(5) A method for processing a photographic silver halide photosensitive material with a developer within a total processing time of 20 to 100 seconds on a dry-to-dry basis.

(6) A method for processing a photographic silver halide photosensitive material with a developer in an automatic developing machine, wherein the automatic developing machine includes a drying section having an infrared drying means.

(7) A method for processing a photographic silver halide photosensitive material with a developer in an automatic developing machine, wherein the automatic developing machine includes a roller disposed upstream of a drying section for guiding forward the photosensitive material in contact, the roller being heated at 70° C. or higher, preferably 70° to 130° C., more preferably 90° to 120° C. by a heater means.

(8) A method for processing a photographic silver halide photosensitive material with a developer in an automatic developing machine, wherein the automatic developing machine includes cartridges containing a developer stock and a fixer stock and chemical mixers wherein the cartridges are emptied of the developer and fixer stocks at the same time.

(9) A method for processing a photographic silver halide photosensitive material with a developer in an automatic developing machine, wherein the automatic developing machine includes a developing tank having an aperture of up to 0.04 cm$^{-1}$, preferably 0 to 0.04 cm$^{-1}$.

(10) A method for processing a photographic silver halide photosensitive material with a developer and then with a fixer in an automatic developing machine on a just-before-use mixing/diluting system wherein each of a one-part developer concentrate and a one-part fixer concentrate is dispensed and diluted with water in a mixing tank to form a ready-to-use solution which is supplied to the running solution as a replenisher.

(11) The method of embodiment (10) wherein each of the developer concentrate and the fixer concentrate is contained in a container in the form of an integral package.

(12) A method for processing a photographic silver halide photosensitive material with a developer in an automatic developing machine, wherein the automatic developing machine includes developing, fixing and washing tanks, a rinse tank with a rinse roller or crossover roller disposed between the developing and fixing tanks, and another rinse tank with a rinse roller or crossover roller disposed between the fixing and washing tanks.

(13) The method of embodiment (12) wherein the automatic developing machine further includes a water stock tank for feeding water containing a bio-slime preventing agent or antiseptic agent to the washing and rinse tanks.

(14) The method of embodiment (12) wherein the washing tank has a drain port which is provided with an electromagnetic valve.

(15) A method for processing a photographic silver halide photosensitive material with a developer and then with a fixer wherein the fixer is available in powder form.

(16) A method for processing a photographic silver halide photosensitive material with a developer and then with a fixer wherein the developer and fixer are ready-to-use solutions.

(17) A method for processing a photographic silver halide photosensitive material in an automatic developing machine which includes a washing tank in the form of a multi-compartment tank or a multi-stage countercurrent washing tank.

(18) A method for processing a photographic silver halide photosensitive material with a developer wherein the developer is stored in a container having an oxygen permeability of 0 to 50 ml/m$^2$·atm·day at 20° C. and RH 65%.

(19) A method for processing a photographic silver halide photosensitive material with a developer and then with a fixer wherein the fixer contains 0 to 0.3 mol/liter of a meso-ionic compound.

EXAMPLE

Examples of the invention are given below by way of illustration and not by way of limitation.

Example 1

Developer A (concentrate)

Ethylenediaminepentaacetic acid 2.5 g

Potassium sulfite 75.0 g

Sodium carbonate monohydrate 10.0 g

Potassium bromide 1.0 g 5-methylbenzotriazole 0.06 g 2-mercaptobenzimidazole-5-sulfonic acid 0.06 g 2,3,5,6,7,8-hexahydro-2-thioxo-(1H)-quinazolinone 0.06 g Diethylene glycol 15.0 g 4-methyl-4-hydroxymethyl-1-phenyl-3-pyrazolidone 3.0 g Hydroquinone 28.0 g Sodium erythorbate* 6.0 g Posassium hydroxide (adjust to pH 10.40)

Note that erythorbic acid is a diastereomer of ascorbic acid A-1.

Water was added to the ingredients to form 400 ml of a concentrate, which was adjusted to pH 10.40 with potassium hydroxide. On use, 600 ml of water was added to the concentrate to give 1 liter of a ready-to-use solution.

Developer B

To 400 ml of developer A (concentrate) was added 2.4 grams of compound I-1.

Developer C

To 400 ml of developer A (concentrate) was added 2.8 grams of compound I-2.

A cubic package of 10-liter size having a multi-layer wall of nylon and polyethylene and a low oxygen permeability of 5 ml/m$^2$·24 hr·atm at 20° C. and RH 65% as disclosed in JP-A 73147/1986 is well known in the photographic art as a developer container. Each of developer concentrates A to C, 10 liters, was contained in the package and stored for 6 months at room temperature varying between 15° C. and 30° C. Each developer as prepared was colorless and clear. As the storage time was extended, there was gradually formed a substance having an absorption peak at 410 nm so that the developer changed its outer appearance to pale yellow, yellow, pale brown or brown depending on its particular composition. A change of outer appearance and an absorbance at 410 nm are reported in Table 1. It is noted that developers A to C as prepared all had an absorbance of 0.03 at 410 nm.

TABLE 1

| Developer | Absorbance @ 410 nm | Outer appearance |
|---|---|---|
| A (comparison) | 3.50 | brown |
| B (invention) | 0.65 | pale brown |
| C (invention) | 0.45 | yellow |

As is evident from Table 1, developer A turned brown and increased the absorbance at 410 nm from 0.03 to 3.50 during 6 month storage. In contrast, developers B and C within the scope of the invention were advantageous owing to a drastically suppressed increase of absorbance at 410 nm and a restricted degree of coloring.

Next, developer concentrates A to C immediately after preparation and after 6-month storage were diluted into ready-to-use solutions. Using these developer solutions, Fuji printing plate film AL, Fuji printing plate film HL, Fuji image recording film CR780, and Fuji image recording film 780H, all manufactured by Fuji Photo-Film Co., were processed through an automatic processor. The processor had developing, fixing, washing and drying sections which were operated under the following conditions.

| Step | Temperature | Time |
|---|---|---|
| Developing | 35° C. | 20 sec. |
| Fixing | 35° C. | 20 sec. |
| Washing | (flowing water) | 20 sec. |
| Drying | 55° C. | 20 sec. |

The fixer used herein was a fixer GR-F1 manufactured by Fuji Photo-Film Co.

Photographic results were satisfactory in all the runs. Advantageously developers B and C were free of doubt about quality drop because their outer appearance remained unchanged.

Example 2

Developer D (concentrate)

Diethylene glycol 25.0 g

Diethylenetriaminepentaacetic acid 4.0 g
Sodium sulfite 10.0 g
Potassium hydrogen carbonate 18.0 g
Potassium carbonate 2.2 g
Sodium carbonate monohydrate 26.0 g
Sodium erythorbate 30.0 g
4-methyl-4-hydroxymethyl-1-phenyl-3-pyrazolidone 6.6 g
3,3'-dithiobishydrocinnamic acid 0.5 g
2,5-dimercapto-1,3,4-thiadiazole 0.1 g
2-(1,2-dicarboxyethyl)thio-5-mercapto-1,3,4-thiadiazole 0.2 g
Potassium bromide 8.0 g Water was added to the ingredients to form 500 ml of a concentrate. On use, 500 ml of water was added to the concentrate to give 1 liter of a ready-to-use solution, which was adjusted to pH 9.70.

Developer E

To 500 ml of developer D (concentrate) was added 3.50 grams of compound I-2.

Developer F

To 500 ml of developer D (concentrate) was added 3.44 grams of compound I-3.

Each of developer concentrates D to F, 2 liters, was contained in a package of flexible composite film. The flexible composite film consisted of inner and outer films. The inner film had an oxygen permeability of 5 ml/$m^2$·24 hr·atm at 20° C. and RH 65% and a water permeability of 0.7 ml/$m^2$·24 hr·atm at 40° C. and RH 90%. The outer film had an oxygen permeability of 2,500 ml/$m^2$·24 hr·atm at 20° C. and RH 65% and a water permeability of 6.4 ml/$m^2$·24 hr·atm at 40° C. and RH 90%. These films were formed by properly combining low density polyethylene (LDPE), high density polyethylene (HDPE), LLDPE, CPP, PET, EVA, OPP, polyamide (PA), EVOH, polyvinylidene chloride (PVDC), NY, 6-NY, and SiOx·PET and selecting a suitable gage. A flexible packaging container was prepared by sealing a pair of composite film pieces along four sides.

The developer in the package was stored for 6 months in a laboratory at a temperature varying between 15° C. and 30° C. and visually observed for outer appearance. Each developer as prepared was colorless and clear. As the storage time was extended, there was gradually formed a substance having an absorption peak at 410 nm so that the developer changed its outer appearance to pale yellow, yellow, pale brown, brown or dark brown depending on its particular composition. A change of outer appearance and an absorbance at 410 nm are reported in Table 2. It is noted that developers D to F as prepared all had an absorbance of 0.05 at 410 nm.

TABLE 2

| Developer | Absorbance @ 410 nm | Outer appearance |
|---|---|---|
| D (comparison) | 6.00 | dark brown |
| E (invention) | 0.65 | pale brown |
| F (invention) | 0.90 | brown |

As is evident from Table 2, developer D turned dark brown and increased the absorbance at 410 nm from 0.05 to 6.00 during 6 month storage even though the container of packaging material having low oxygen permeability was used. In contrast, developers E and F within the scope of the invention were advantageous owing to a drastically suppressed increase of absorbance at 410 nm and a restricted degree of coloring.

Next, developer concentrates D to F immediately after preparation and after 6-month storage were diluted into ready-to-use solutions. Using these developer solutions, Fuji Medical X-ray Film Super HR-S30, Super HR-G30, Super HR-A30, Super HR-HA30, Super HR-L30, Super HR-C30 and Fuji Medical X-ray Film UR-1, UR-2 and UR-3, all manufactured by Fuji Photo-Film Co., were processed through an automatic processor. The processor had developing, fixing, washing and drying sections which were operated under the following conditions.

| Step | Temperature | Time |
|---|---|---|
| Developing | 35° C. | 20 sec. |
| Fixing | 35° C. | 17 sec. |
| Washing | (flowing water) | 10 sec. |
| Drying | 55° C. | 17 sec. |

The fixer used herein was a fixer CE-F2 manufactured by Fuji Photo-Film Co.

Photographic results were satisfactory in all the runs. Advantageously developers E and F were free of doubt about quality drop because their outer appearance remained unchanged.

Example 3

Each of developers A to C in Example 1 was stored in a packaging material container of the cubic type originally designed for the storage of medical film developer RD-20 of Fuji Photo-Film Co. This packaging material had an oxygen permeability of 3 ml/$m^2$·24 hr·atm at 20° C. and RH 65%. A test was carried out as in Example 1 to find equivalent results for the respective developers A to C.

Example 4

Five photosensitive materials (a), (b), (c), (d), and (e) were prepared as follows.

Photosensitive material (a)

A photographic silver halide photosensitive material was prepared which included a silver halide emulsion layer containing 80% of tabular silver halide grains having an aspect ratio of at least 3.0 based on the projected area of entire silver halide grains and had a swelling factor of 180%.

(1) Preparation of emulsion

To 1 liter of water were added 20 grams of gelatin, 5 grams of potassium bromide, and 3 ml of an aqueous solution of 5% thioether $HO(CH_2)_2S(CH_2)_2S(CH_2)_2OH$. While the solution was kept at 75° C., with stirring, an aqueous solution containing 8.35 grams of silver nitrate and an aqueous solution containing 3 grams of potassium bromide and 0.4 gram of potassium iodide were added over 45 seconds by a double jet mixing method. An aqueous solution containing 5 grams of silver nitrate and 2 grams of potassium bromide was then added over 10 minutes. Subsequently, an aqueous solution containing 135 grams of silver nitrate and an aqueous solution of potassium bromide were added over 25 minutes by a controlled double jet mixing method while maintaining the solution potential at pAg 8.1. At this time the flow rate was accelerated such that the flow rate at the end of addition was 10 times the flow rate at the start of addition. At the end of addition, 15 ml of a 2N potassium thiocyanate solution was added. The temperature was then lowered to 35° C. whereupon soluble salts were removed by sedimentation. The temperature was raised to 40° C. whereupon 35 grams of gelatin, 2.5 grams of phenoxyethanol, and a thickener were added to the solution, which was adjusted to pH 6.1 and pAg 8.3 with caustic soda, potassium bromide, and silver nitrate solution. The temperature was raised to 56° C. whereupon 735 mg of a sensitizing dye of the structure shown below was added. After 10 minutes, $0.96\times10^{-5}$ mol (per mol of Ag) of $Ph_3P{=}Se$, $0.64\times10^{-5}$ mol (per mol of Ag) of sodium thiosulfate, 110 mg of potassium thiocyanate, and 2.6 mg of chloroauric acid were added to the solution, which was ripened for 60 minutes. The solution was rapidly cooled for solidification.

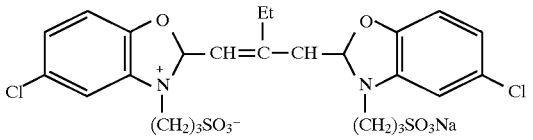

The resulting emulsion contained 93% based on the projection area of entire grains of grains having an aspect ratio of at least 3.0. Those grains having an aspect ratio of at least 3.0 had an average projection area diameter of 1.4 μm with a standard deviation of 20% and an average thickness of 0.2 μm. Thus their average aspect ratio was 7.

Using the above-prepared emulsion, a photosensitive material was prepared in the form of a coated sample of the structure shown below. Note that the coverage is an amount per square meter of photosensitive material.

(2) Preparation of emulsion coating composition

A coating composition was prepared by adding the following chemicals to the emulsion in the amounts reported per mol of silver halide.

| Chemical | Amount |
|---|---|
| Polymer latex: poly(ethyl acrylate/methacrylic acid) = 97/3 | 20 g |
| 2,6-bis(hydroxyamino)-4-diethylamino-1,3,5-triazine | 72 mg |
| Potassium hydroquinone monosulfonate | 9 g |
| Gelatin | an amount to give a coverage of 1.0 g/m$^2$ |
| Trimethylolpropane | 9 g |
| Sodium polyacrylate (average Mw 41,000) | 2.1 g |
| Sodium polystyrenesulfonate (average Mw 600,000) | 1.5 g |
| Hardener: 1,2-bis(vinylsulfonyl-acetamide)ethane | an amount to give a swelling factor of 180% |
| 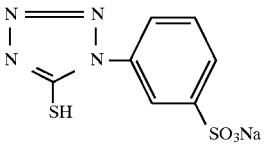 | 34 mg |

(3) Preparation of surface protective layer coating composition

The surface protective layer coating composition was prepared so as to form a surface protective layer consisting of the following components in the following coverage.

| Component | Coverage |
|---|---|
| Gelatin | 0.966 g/m$^2$ |
| Sodium polyacrylate (average Mw = 400,000) | 0.023 g/m$^2$ |
| 4-hydroxy-6-methyl-1,3,3a,7-tetraazaindene | 0.015 g/m$^2$ |

-continued

| Component | Coverage |
|---|---|
| 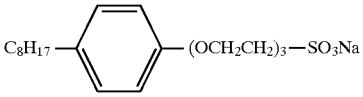 | 0.013 g/m$^2$ |
| $C_{16}H_{33}O-(OCH_2CH_2O)_{10}-H$ | 0.045 g/m$^2$ |
| $C_{17}H_{33}CON(CH_3)CH_2CH_2SO_3Na$ | 0.0065 g/m$^2$ |
| $C_8F_{17}SO_2N(C_3H_7)-(CH_2CH_2O)_{15}-H$ | 0.003 g/m$^2$ |
| $C_8F_{17}SO_2N(C_3H_7)-(CH_2CH_2O)_4-(CH_2)_4-SO_3Na$ | 0.001 g/m$^2$ |
| Polymethyl methacrylate (mean particle size 3.7 μm) | 0.087 g/m$^2$ |
| Proxcel (adjusted to pH 7.4 with NaOH) | 0.0005 g/m$^2$ |

(4) Preparation of support (4-1) Preparation of dye for undercoat layer

The following dye was ball milled in accordance with the teaching of JP-A 197943/1988.

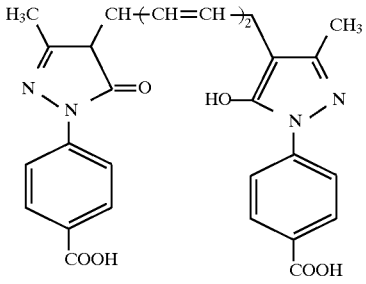

A 2-liter ball mill was charged with 434 ml of water and 791 ml of an aqueous solution of 6.7% Triton X-200 surfactant (TX-200). To the mixed solution was added 20 grams of the dye. The mill was charged with 400 ml of zirconium oxide ($ZrO_2$) beads having a diameter of 2 mm and the contents were milled for 4 days. Then 160 grams of 12.5% gelatin was added to the mill. After debubbling, the $ZrO_2$ beads were removed by filtration. The resulting dye dispersion was observed to find that the milled dye had a wide distribution of particle size ranging from 0.05 to 1.15 μm in diameter with a mean particle size of 0.30 μm. Coarse dye particles having a size of 0.9 μm or larger were centrifugally removed. There was obtained a dye dispersion.

(4-2) Preparation of support

A biaxially oriented polyethylene terephthalate (PET) film of 183 μm thick was furnished. The PET film contained 0.04% by weight of a dye of the following structure.

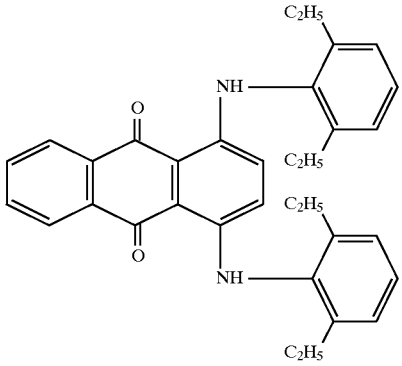

The film on one surface was treated with a corona discharge, coated with a first undercoat liquid of the following composition to a buildup of 5.1 ml/m$^2$ by means of a wire bar coater, and then dried for one minute at 175° C. Then, a first undercoat layer was similarly formed on the opposite surface of the film.

| First undercoat composition | |
|---|---|
| Butadiene-styrene copolymer latex solution* (solids 40%, butadiene/styrene weight ratio = 31/69) | 79 ml |
| 4% sodium 2,4-dichloro-6-hydroxy-s-triazine solution | 20.5 ml |
| Distilled water | 900.5 ml |

*The latex solution contained 0.4% by weight based on the latex solids of $nC_6H_{13}OOCCH_2$ | $nC_6H_{13}OOCCH—SO_3Na$ as an emulsion dispersant.

Next, a second undercoat layer of the following composition was coated on each of the first undercoat layers on opposite surfaces of the film by means of a wire bar coater and then dried at 150° C.

| Second undercoat composition | Coverage |
|---|---|
| Gelatin | 160 mg/m$^2$ |
| Dye dispersion | 26 mg/m$^2$ of dye solids |
| 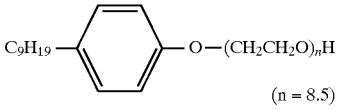 (n = 8.5) | 8 mg/m$^2$ |
| 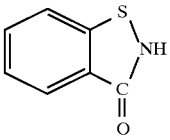 | 0.27 mg/m$^2$ |
| Matte agent, polymethyl methacrylate (mean particle size 2.5 μm) | 2.5 mg/m$^2$ |

(5) Preparation of photosensitive material

The emulsion coating composition and the surface protective layer coating composition both formulated above were coated on each surface of the above-prepared support by a co-extrusion method. The amount of silver coated was 1.30 g/m$^2$ on each surface. The amounts of gelatin and hardener added to the emulsion layer were adjusted to provide a desired swelling factor as determined by a freeze dry method using liquefied nitrogen. A photosensitive material (a) was obtained in this way.

Photosensitive material (b)

A photographic silver halide photosensitive material was prepared as (a) which included a silver halide emulsion layer containing 40% of tabular silver halide grains having n aspect ratio of at least 3.0 based on the projected area of entire silver halide grains and had a swelling factor of 180%.

Photosensitive material (c)

A photographic silver halide photosensitive material was prepared as (a) which included a silver halide emulsion layer containing 93% of tabular silver halide grains having an aspect ratio of at least 3.0 based on the projected area of entire silver halide grains and had a swelling factor of 100%.

It is understood that the above-mentioned photosensitive materials (a), (b), and (c) were fabricated by preparing silver halide emulsions in accordance with a proper combination of methods known for the preparation of tabular silver halide grains (as described in JP-A 127921/1983, 113927/1983, 11392/1983, and U.S. Pat. No. 4,439,520), and adjusting the amount of hardener to provide a desired swelling factor.

Photosensitive material (d)

This photosensitive material was prepared by coating an emulsion of silver halide cubic grains which was prepared as described below. A swelling factor of 150% was given by adjusting the amount of hardener.

With stirring, an aqueous solution of 0.13M silver nitrate and an aqueous halide solution containing $1.5\times10^{-7}$ mol of $K_2Rh(H_2O)Cl_5$, $2\times10^{-7}$ mol of $K_3IrCl_6$, 0.04 mol of potassium bromide, and 0.09 mol of sodium chloride per mol of silver in the finished emulsion were added to an aqueous gelatin solution containing sodium chloride and 1,3-dimethyl-2-imidazolidinethion at 38° C. over 12 minutes by a double jet mixing method, yielding silver chlorobromide grains having a mean grain size of 0.14 μm and a silver chloride content of 70 mol % for nucleation. Thereafter, an aqueous solution of 0.87M silver nitrate and an aqueous halide solution containing 0.26M of potassium bromide and 0.65M of sodium chloride were similarly added over 20 minutes by a double jet mixing method. Thereafter, a solution of $1\times10^{-3}$ mol of KI was added for conversion. Subsequently the solution was conventionally washed with water by a flocculation method using a copolymer of isobutene and monosodium maleate as a sedimenting agent. After adding 40 g per mol of silver of gelatin, adjusting to pH 6.5 and pAg 7.5, and adding per mol of silver 7 mg of sodium benzenethiosulfonate, 2 mg of benzenesulfinic acid, 8 mg of chloroauric acid, 200 mg of potassium thiocyanate, and 5 mg of sodium thiosulfate, the solution was subject to chemical sensitization by heating at 60° C. for 45 minutes. To the solution were added 150 mg of 4-hydroxy-6-methyl-1,3,3a,7-tetrazaindene as a stabilizer and 100 mg of proxcel as an antiseptic agent. There were obtained silver iodochlorobromide cubic grains having a mean grain size of 0.25 μm and a silver chloride content of 69.9 mol % (variation coefficient 10%).

Photosensitive material (e)

This photosensitive material was prepared by coating an emulsion of silver halide cubic grains which was prepared as described below. A swelling factor of 150% was given by adjusting the amount of hardener.

With stirring, an aqueous solution of 0.37M silver nitrate and an aqueous halide solution containing $1.0\times10^{-7}$ mol of $(NH_4)_3RhCl_5$, $2\times10^{-7}$ mol of $K_3IrCl_6$, 0.11 mol of potassium bromide, and 0.27 mol of sodium chloride per mol of silver in the finished emulsion were added to an aqueous gelatin solution containing sodium chloride and 1,3-dimethyl-2-imidazolidinethion at 45° C. over 12 minutes by a double jet mixing method, yielding silver chlorobromide grains having a mean grain size of 0.20 μm and a silver chloride content of 70 mol % for nucleation. Thereafter, an aqueous solution of 0.63 mol silver nitrate and an aqueous halide solution containing 0.19 mol of potassium bromide and 0.47 mol of sodium chloride were similarly added over 20 minutes by a double jet mixing method. Thereafter, a solution of $1\times10^{-3}$ mol of KI per mol of silver was added for conversion. Subsequently the solution was conventionally washed with water by a flocculation method. After adding 40 grams of gelatin, adjusting to pH 6.5 and pAg 7.5, and adding per mol of silver 7 mg of sodium benzenethiosulfonate, 5 mg of sodium thiosulfate, and 8 mg of chloroauric acid, the solution was subject to chemical sensitization by heating at 60° C. for 45 minutes. To the solution were added 150 mg of 4-hydroxy-6-methyl-1,3,3a,7-tetrazaindene as a stabilizer and proxcel as an antiseptic agent. There were obtained silver chlorobromide cubic grains having a mean grain size of 0.28 μm and a silver chloride content of 70 mol % (variation coefficient 9%).

(6) Preparation of developer

There were prepared developers G, H, and J having the following compositions.

Developer G (concentrate)

Sodium erythorbate 30.0 g

Sodium sulfite 15.0 g

Potassium carbonate 55.2 g 4-methyl-4-hydroxymethyl-1-phenyl-3-pyrazolidone 5.0 g Diethylene glycol 25.0 g Diethylenetriaminepentaacetic acid 3.0 g 5-methylbenzotriazole 0.1 g 2,5-dimercapto-1,3,4-thiadiazole 0.1 g 2-(1,2-dicarboxyethyl)thio-5-mercapto-1,3,4-thiadiazole 0.2 g 3,3'-dithiobishydrocinnamic acid 0.4 g Potassium bromide 5.0 g Water was added to the ingredients to form 500 ml of a concentrate which was adjusted to pH 9.70. On use, 500 ml of water was added to the concentrate to give 1 liter of a ready-to-use solution.

Developer H

To 500 ml of developer G (concentrate) was added 2.4 grams of compound I-1.

Developer J

To 500 ml of developer G (concentrate) was added 2.8 grams of compound I-2.

A running test was carried out by means of an automatic processor, Fuji Medical Film Processor CEPROS-S by Fuji Photo-Film Co. using the above-prepared photosensitive materials and developers. 500 ml of water was added to developer concentrates G, H, and J to form 1 liter of developer solutions or ready-to-use solutions G, H, and J. Photosensitive materials (a) to (e) were processed with developer solution G, H or J at a film processing rate of 5 $m^2$/day and then with a fixer solution. A running test was continued for 2 weeks while replenishing the developer solution in an amount of 150 ml/$m^2$. The fixer solution used was CE-F2 by Fuji Photo-Film Co. Development was carried out at a temperature of 35° C. for 17.8 seconds. The total processing time was 60 seconds on a dry-to-dry basis. The results are shown in Table 3. Note that sensitivity is reported as a relative value on the basis that the reciprocal of an exposure dose required to provide a blackening degree of fog +1.0 is 100.

TABLE 3

| Test No. | Photo-sensitive material | Silver halide grain shape | Silver halide grain area % | Swelling factor | Developer (formula (I) compound) | Sensitivity Fresh solution | Sensitivity Running solution |
|---|---|---|---|---|---|---|---|
| 1* | a | tabular | 93% | 180% | G (none) | 100 | 95 |
| 2 | a | tabular | 93% | 180% | H (compound I-1) | 100 | 100 |
| 3 | a | tabular | 93% | 180% | J (compound I-2) | 98 | 98 |
| 4* | b | tabular | 40% | 180% | G (none) | 70 | 66 |
| 5* | b | tabular | 40% | 180% | H (compound I-1) | 70 | 70 |
| 6* | b | tabular | 40% | 180% | J (compound I-2) | 68 | 68 |
| 7* | c | tabular | 93% | 100% | G (none) | 60 | 57 |
| 8* | c | tabular | 93% | 100% | H (compound I-1) | 60 | 60 |
| 9* | c | tabular | 93% | 100% | J (compound I-2) | 58 | 58 |
| 10* | d | cubic | — | 150% | G (none) | 10.0 | 8.0 |
| 11* | d | cubic | — | 150% | H (compound I-1) | 10.0 | 9.0 |
| 12* | d | cubic | — | 150% | J (compound I-2) | 9.8 | 8.8 |
| 13* | e | cubic | — | 150% | G (none) | 14.0 | 11.2 |
| 14* | e | cubic | — | 150% | H (compound I-1) | 14.0 | 12.6 |
| 15* | e | cubic | — | 150% | J (compound I-2) | 13.8 | 12.4 |

*comparison

It is seen from Table 3 that in test Nos. 10 to 15 pertaining to cubic grains, the running solution showed a sensitivity drop of about 20% as compared with the fresh solution. In test Nos. 1 to 9 pertaining to tabular grains, the running solution showed a less sensitivity drop as compared with the fresh solution. In particular, developer solutions H and J containing compound No. I-1 or I-2 experienced no sensitivity drop. Photosensitive material (b) had low sensitivity due to a low proportion of tabular grains (test Nos. 4, 5, and 6). Photosensitive material (b) had low sensitivity due to a low swelling factor (test Nos. 7, 8, and 9). When photosensitive material (a) containing a high proportion of tabular grains and having a swelling factor of 180% within the scope of the invention was developed with developer solution H or J containing compound I-1 or I-2, satisfactory results were obtained in that the sensitivity was high and remained unchanged when processed with the running solution. The addition of compound I-1 or I-2 eliminated a drop of sensitivity although a sensitivity drop of 5 or 6% was otherwise inevitable.

Example 5

Developer K (concentrate)

Hydroquinone 30.0 g

Sodium erythorbate 6.0 g

Potassium sulfite 70.0 g

Sodium carbonate monohydrate 24.8 g 4-methyl-4-hydroxymethyl-1-phenyl-3-pyrazolidone 3.0 g Diethylene glycol 10.0 g Diethylenetriaminepentaacetic acid 2.0 g 5-methylbenzotriazole 0.06 g 2,5-dimercapto-1,3,4-thiadiazole 0.06 g 2-mercaptobenzimidazole-5-sulfonic acid 0.06 g Potassium bromide 5.0 g Water was added to the ingredients to form 400 ml of a concentrate. On use, 600 ml of water was added to the concentrate to give 1 liter of a ready-to-use solution, which was adjusted to pH 10.20.

Developer L

To 400 ml of developer K (concentrate) was added 2.8 grams of compound I-2.

A running test was carried out as in Example 4 using photosensitive materials (a), (b), (c), and (d) prepared in Example 4 and developer solutions or ready-to-use solutions K and L which were prepared by adding 600 ml of water to developer concentrates K and L to a total volume of 1 liter. The results are shown in Table 4.

TABLE 4

| Test No. | Photo-sensitive material | Silver halide grain shape | Silver halide grain area % | Swelling factor | Developer (formula (I) compound) | Sensitivity Fresh solution | Sensitivity Running solution |
|---|---|---|---|---|---|---|---|
| 21* | a | tabular | 93% | 180% | K (none) | 130 | 124 |
| 22 | a | tabular | 93% | 180% | L (compound I-2) | 130 | 130 |
| 23* | b | tabular | 40% | 180% | K (none) | 90 | 86 |
| 24* | b | tabular | 40% | 180% | L (compound I-2) | 90 | 90 |
| 25* | c | tabular | 93% | 100% | K (none) | 78 | 74 |
| 26* | c | tabular | 93% | 100% | L (compound I-2) | 78 | 78 |
| 27* | d | cubic | — | 150% | K (none) | 13.0 | 10.4 |
| 28* | d | cubic | — | 150% | L (compound I-2) | 13.0 | 11.7 |

*comparison

It is seen from Table 4 that in test No. 22 wherein photosensitive material (a) containing a high proportion of tabular grains and having a swelling factor of 180% within the scope of the invention was developed with developer solution L containing compound I-2 on a running basis, satisfactory results were obtained in that the sensitivity was high and remained unchanged when processed with the running solution. The addition of compound I-2 eliminated a drop of sensitivity although a sensitivity drop of 4 or 5% was otherwise inevitable.

There has been described a photographic liquid developer using an ascorbic acid imposing a less burden of pollution wherein a compound of formula (I) is added for preventing the developer in a sealed package from coloring with the lapse of time. When a photographic silver halide photosensitive material comprising a silver halide emulsion layer containing at least 50% based on the projected area of tabular silver halide grains with an aspect ratio of at least 3.0 and having a swelling factor of 130 to 250% is developed with the developer on a running basis, the addition of a compound of formula (I) to the developer is effective for preventing a sensitivity drop.

Although some preferred embodiments have been described, many modifications and variations may be made thereto in the light of the above teachings. It is therefore to be understood that within the scope of the appended claims, the invention may be practiced otherwise than as specifically described.

We claim:

1. A liquid developer for a photographic silver halide photosensitive material, comprising at least one ascorbic acid compound in an amount of 0.1 to 100 g/L and at least one compound of the following formula (I) in an amount of 0.5 to 100 g/L:

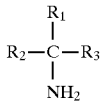

(I)

wherein each of $R_1$ and $R_2$ is a hydroxyalkyl group having 1 to 3 carbon atoms or an alkyl group having 1 to 3 carbon atoms and $R_3$ is a hydroxyalkyl group having 1 to 3 carbon atoms and further comprising at least one auxiliary developing agent having superadditivity that is a 3-pyrazolidone compound in an amount of $10^{-4}$ to $10^{-1}$ mol/l.

2. The liquid developer of claim 1 which is stored in a container of a packaging material having an oxygen permeability of up to 50 ml/m$^2$·24 hr·atm at 20° C. and RH 65%.

3. The liquid developer of claim 1 further comprising 0.01 to 2.5 mol/l of a sulfite.

4. The liquid developer of claim 1 further comprising 0.3 to 1.0 mol/l of an alkaline agent.

5. The liquid developer of claim 1 which is adjusted at pH 8.5 to 12.0.

6. The liquid developer of claim 1 which is adjusted at pH 8.5 to 11.0.

7. The liquid developer of claim 1 which contains 1.0 to 50 g/l of the compound of formula (I).

8. The liquid developer of claim 1 in the form of a ready-to-use solution which contains 0.1 to 100 g/l of the ascorbic acid compound.

9. The liquid developer of claim 1 which contains the ascorbic acid compound as a developing agent.

10. The liquid developer of claim 9 wherein the auxiliary developing agent is contained in an amount of 1 to 50 mol % of the developing agent.

11. The liquid developer of claim 1 that is a ready-to-use solution wherein the amount of the ascorbic acid compound is 1.0 to 100 g/l.

12. The liquid developer of claim 1 that is a ready-to-use solution wherein the amount of the ascorbic acid compound is 5 to 80 g/l.

13. The liquid developer of claim 1, wherein the amount of the 3-pyrazolidone superadditive developing compound is $5\times10^{-4}$ to $5\times10^{-2}$ mol/l of a ready-to-use solution.

14. The liquid developer of claim 1 that is a ready-to-use solution wherein the amount of the compound of formula (I) is 1.0 to 50 g/l, the amount of the ascorbic acid compound is 1.0 to 100 g/l and the amount of the 3-pyrazolidone superadditive developing compound is $5\times10^{-4}$ to $5\times10^{-2}$ mol/l.

15. A method for processing a photographic silver halide photosensitive material comprising at least one layer of a silver halide emulsion containing at least 50% of tabular silver halide grains having an aspect ratio of at least 3.0 based on the projected area of entire silver halide grains, said photosensitive material having a swelling factor of 130 to 250%, said method comprising the step of developing the photosensitive material with a developer solution prepared from the developer of claim 1.

16. The method of claim 15 further comprising the step of replenishing the developer solution in an amount of up to 250 ml per square meter of the silver halide photosensitive material.

17. The method of claim 16 wherein the developer solution is replenished in an amount of 50 to 250 ml/m$^2$.

18. The method of claim 17 wherein the developer solution is replenished in an amount of 100 to 200 ml/m$^2$.

19. The method of claim 15 wherein the silver halide in the silver halide emulsion contains 10 to 100 mol % of silver chloride, 0 to 100 mol % of silver bromide, and 0 to 5 mol % of silver iodide.

* * * * *